US007168799B2

(12) United States Patent
Benson et al.

(10) Patent No.: US 7,168,799 B2
(45) Date of Patent: Jan. 30, 2007

(54) RELEASE MECHANISM FOR FACILITATING SUPPLY CARTRIDGE INSTALLATION AND REMOVAL

(75) Inventors: Michael James Benson, Lexington, KY (US); William M. Connors, Lexington, KY (US); Brian Andrew Naro, Bessemer, AL (US)

(73) Assignee: Lexmark International, Inc., Lexington, KY (US)

( * ) Notice: Subject to any disclaimer, the term of this patent is extended or adjusted under 35 U.S.C. 154(b) by 262 days.

(21) Appl. No.: 10/878,505

(22) Filed: Jun. 28, 2004

(65) Prior Publication Data

US 2005/0285900 A1 Dec. 29, 2005

(51) Int. Cl.
*B41J 2/175* (2006.01)

(52) U.S. Cl. ..... 347/86; 347/85

(58) Field of Classification Search ..... 347/49, 347/86, 87, 85

See application file for complete search history.

(56) References Cited

U.S. PATENT DOCUMENTS 5,619,237 A 4/1997 Inoue et al.
6,250,750 B1 6/2001 Miyazawa et al.
6,293,662 B1 9/2001 Shihoh et al.
6,361,158 B1 3/2002 Inoue et al.
6,367,918 B1 4/2002 Heiles et al.
6,481,829 B1 11/2002 Bailey et al.
6,634,738 B1 10/2003 Shinada et al.
6,648,456 B1 11/2003 Asano
6,736,486 B2 * 5/2004 Nakamura et al. ..... 347/49
2003/0214557 A1 11/2003 Nakamura et al.

* cited by examiner

*Primary Examiner*—Lamson Nguyen
*Assistant Examiner*—Lisa M. Solomon
(74) *Attorney, Agent, or Firm*—Taylor & Aust

(57) ABSTRACT

A printhead carrier includes a body defining a receptacle for receiving a supply cartridge. The body includes a front portion, and a rear portion spaced from the front portion. The rear portion has a latch opening. A cover is provided having a first end configured for pivotal attachment to the front portion of the body. A latch arm has a proximal end attached to the cover. A distal end of the latch arm includes a latch lip. The latch lip engages the latch opening in the rear portion of the body when the cover is in a closed position. A release mechanism is coupled to the rear portion of the body. The release mechanism includes a cam for engaging the latch lip of the latch arm to force the latch lip out of the latch opening when the release mechanism is moved from a latch position to a latch release position.

7 Claims, 5 Drawing Sheets

RELEASE MECHANISM FOR FACILITATING SUPPLY CARTRIDGE INSTALLATION AND REMOVAL

BACKGROUND OF THE INVENTION

1. Field of the Invention

The present invention relates to an imaging apparatus, and, more particularly, to a release mechanism for facilitating cartridge installation and removal.

2. Description of the Related Art

A typical ink jet printer forms an image on a print medium by ejecting ink from a plurality of ink jetting nozzles of an ink jet printhead to form a pattern of ink dots on the print medium. The ink jet printhead may be formed integral with a cartridge containing a supply of ink, thus forming a supply cartridge, and more particularly, a printhead cartridge. Such an ink jet printer typically includes a reciprocating printhead carrier that mounts one or more printhead cartridges in respective receptacles. Once mounted, the printhead carrier carriers the printhead cartridges across the print medium along a bi-directional scanning path defining a print zone of the printer. A sheet feeding mechanism is used to incrementally advance the print medium sheet in a sheet feed direction, also commonly referred to as a sub-scan direction, through a print zone between scans in the main scan direction, or after all data intended to be printed with the print medium at a particular stationary position has been completed.

Some printers include on the printhead carrier a cover, e.g., lid, and latch arrangement for mounting and retaining a printhead cartridge in its respective receptacle in the printhead carrier. Efforts have been made to make the cover and latch arrangements more user friendly, but often times the cover and latch arrangements are not intuitive to operate.

What is needed in the art is an easy to use release mechanism for facilitating cartridge installation and removal in a printhead carrier.

SUMMARY OF THE INVENTION

The present invention provides an easy to use release mechanism for facilitating cartridge installation and removal in a printhead carrier.

The present invention, in one form thereof, relates to an imaging apparatus having a printhead carrier. The printhead carrier includes a body defining a receptacle for receiving a supply cartridge. The body includes a front portion, and a rear portion spaced from the front portion. The rear portion has a latch opening. A cover, e.g., a lid, is provided having a first end and a second end. The first end is configured for pivotal attachment to the front portion of the body. A latch arm has a proximal end and a distal end. The proximal end is attached to the cover. The distal end includes a latch lip. The latch lip engages the latch opening in the rear portion of the body when the cover is in a closed position. A release mechanism is coupled to the rear portion of the body. The release mechanism is pivotable between a latch position and a latch release position. The release mechanism includes a cam for engaging the latch lip of the latch arm to force the latch lip out of the latch opening when the release mechanism is moved from the latch position to the latch release position.

The present invention, in another form thereof, relates to a method for releasing a cover having a first end and a second end, the first end being configured for pivotal attachment to a front portion of a body defining a receptacle for receiving a supply cartridge. The method includes providing a latch arm having a proximal end and a distal end, the proximal end being attached to the cover, the distal end including a latch lip, the latch lip engaging a latch opening in a rear portion of the body when the cover is in a closed position; and pivoting a release mechanism between a latch position and a latch release position, the release mechanism forcing the latch lip out of the latch opening when the release mechanism is moved from the latch position to the latch release position.

The present invention, in another form thereof, relates to an imaging apparatus having a printhead carrier. The printhead carrier includes body defining a receptacle for receiving a supply cartridge. The body includes a front portion, and a rear portion spaced from the front portion. A cover has a first end and a second end, with the first end being configured for pivotal attachment to the front portion of the body. A latch arm has a proximal end and a distal end. The proximal end is attached to the cover. A latch bar extends from the cover in a direction substantially perpendicular to an extent of the latch arm. A member is attached to the latch arm. The member has a first leg and a second leg, and a divergence portion defined where the first leg and the second leg separate. A latch lever is pivotally coupled to the rear portion of the body. The latch lever has a latch catch for engaging the latch bar when the cover is in a closed position. The latch lever includes a guide channel having an engagement ledge. The guide channel is configured for receiving the first leg of the member when the cover is pivoted toward the closed position. The divergence portion of the member engages the engagement ledge of the guide channel of the latch lever to pivot the latch lever to a latched position as the cover is pivoted toward the closed position.

The present invention, in another form thereof, relates to a method for releasing a cover having a first end and a second end, the first end being configured for pivotal attachment to a front portion of a body defining a receptacle for receiving a supply cartridge. The method includes providing a latch arm having a proximal end, a distal end and an intermediate portion between the proximal end and the distal end, the proximal end being attached to the cover; providing a latch bar attached to the cover and extending from the cover in a direction substantially perpendicular to an extent of the latch arm; providing a member attached to the distal end of the latch arm, the member having a first leg and a second leg, and a divergence portion defined where the first leg and the second leg separate; and providing a latch lever pivotally coupled to a rear portion of the body, the latch lever having a latch catch for engaging the latch bar when the cover is in a closed position, the latch lever including a guide channel having an engagement ledge, the guide channel being configured for receiving the first leg of the member when the cover is pivoted toward the closed position, the divergence portion of the member engaging the engagement ledge of the guide channel of the latch lever to pivot the latch lever to a latched position as the cover is pivoted toward the closed position.

An advantage of the present invention is that the release mechanism used to unlatch the cover does not require a spring to return the release mechanism to a closed position due to engagement of the cover latch mechanism with the release mechanism as the cover is closed.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
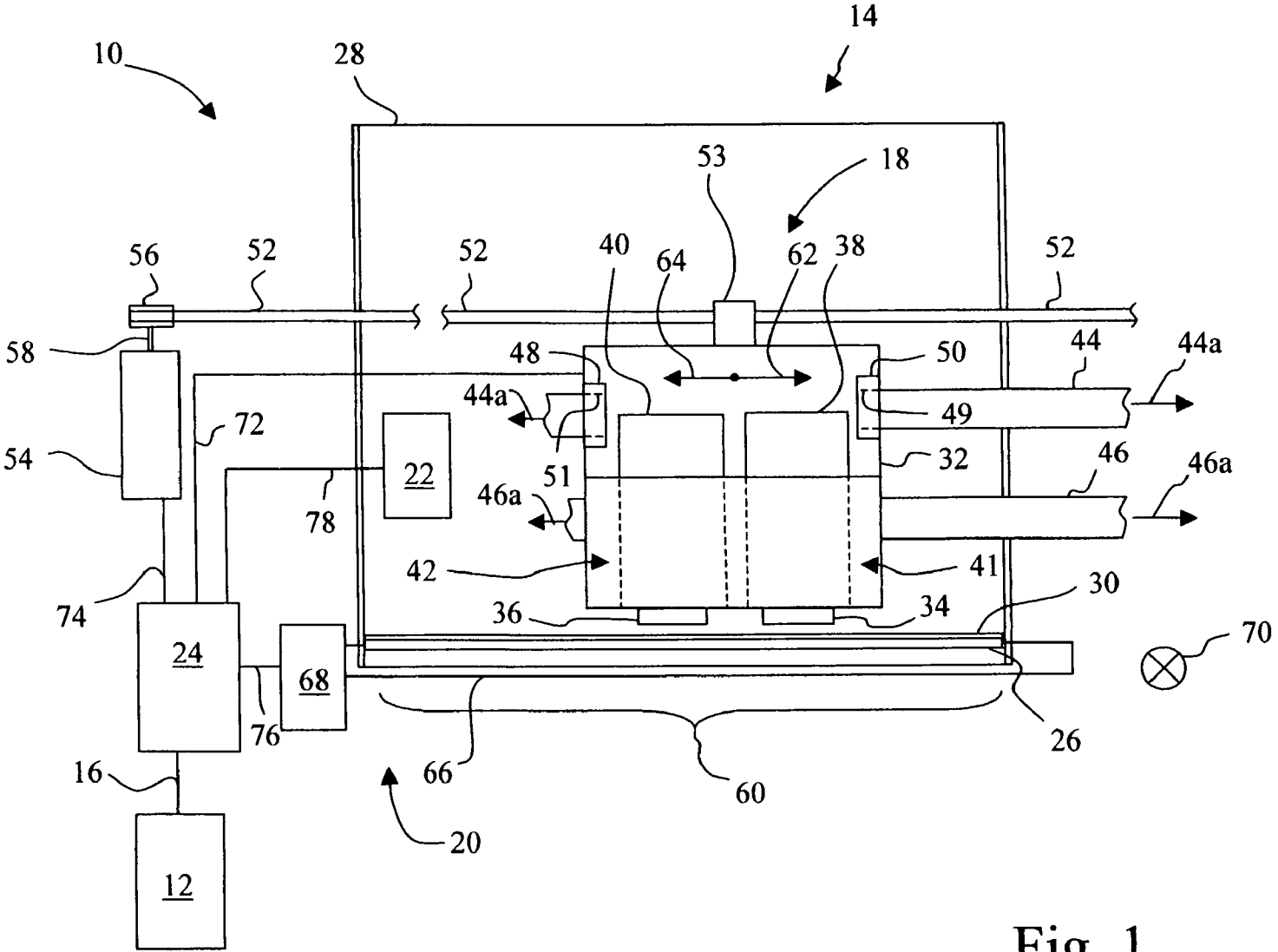
FIG. 1 is a diagrammatic representation of an imaging system embodying the present invention.

Referring now to the drawings, and particularly to FIG. 1, there is shown an imaging system 10 embodying the present invention. Imaging system 10 may include a host 12, or alternatively, imaging system may be a standalone system.

Imaging system 10 includes an imaging apparatus 14, which may be in the form of an ink jet printer 14 as shown. Thus, for example, ink jet printer 14 may be a conventional ink jet printer, or may form the print engine for a multi-function apparatus, such as for example, a standalone unit that has faxing and copying capability, in addition to printing.

Host 12, which may be optional, may be communicatively coupled to ink jet printer 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Ink jet printer 14 includes a printhead carrier system 18, a feed roller unit 20, a sheet picking unit 22, a controller 24, a mid-frame 26 and a media source 28.

Media source 28 is configured to receive a plurality of print media sheets from which a print medium, e.g., a print media sheet 30, is picked by sheet picking unit 22 and transported to feed roller unit 20, which in turn further transports print media sheet 30 during a printing operation. Print media sheet 30 can be, for example, plain paper, coated paper, photo paper and transparency media.

Printhead carrier system 18 includes a printhead carrier 32 for mounting and carrying a standard color printhead 34 and a photo printhead 36, or alternatively a monochrome printhead. A standard color ink reservoir 38 is provided in fluid communication with standard color printhead 34, and a photo ink reservoir 40, or alternatively a monochrome ink reservoir, is provided in fluid communication with photo printhead 36. Those skilled in the art will recognize that color printhead 34 and color ink reservoir 38 may be formed as individual discrete units, or may be combined as an integral unitary printhead cartridge 41. Likewise, photo printhead 36 and photo ink reservoir 40 may be formed as individual discrete units, or may be combined as an integral unitary printhead cartridge 42.

As shown in FIG. 1, printhead carrier 32 is guided by a guide rod 44 and a guide member 46. Each of guide rod 44 and guide member 46 includes a respective horizontal axis 44*a*, 46*a*. Printhead carrier 32 includes a pair of carrier bearings 48, 50, with each of carrier bearings 48, 50 including a respective aperture 49, 51 for receiving guide rod 44. Printhead carrier 32 may further include a glide surface (not shown) that is retained in contact with guide member 46, for example, by gravitational force, or alternatively, by another guide rod bearing or bearing set. The horizontal axis 44*a* of guide rod 44, also sometimes referred to herein as X-axis 44*a*, generally defines a bi-directional scanning path for printhead carrier 32. Accordingly, the bi-directional scanning path is associated with each of printheads 34, 36.

Printhead carrier 32 is connected to a carrier transport belt 52 via a carrier drive attachment device 53. Carrier transport belt 52 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide rod 44 and guide member 46. Carrier motor 54 can be, for example, a direct current (DC) motor or a stepper motor.

The reciprocation of printhead carrier 32 transports ink jet printheads 34, 36 across the print media sheet 30, such as paper, along X-axis 44*a* to define a print zone 60 of ink jet printer 14. The reciprocation of printhead carrier 32 occurs in a main scan direction (bi-directional) that is parallel with X-axis 44*a*, and is also commonly referred to as the horizontal direction, including a left-to-right carrier scan direction 62 and a right-to-left carrier scan direction 64. Generally, during each scan of printhead carrier 32 while printing, the print media sheet 30 is held stationary by feed roller unit 20.

Mid-frame 26 provides support for the print media sheet 30 when the print media sheet 30 is in print zone 60, and in part, defines a portion of a print media path of ink jet printer 14.

Feed roller unit 20 includes a feed roller 66 and corresponding index pinch rollers (not shown). Feed roller 66 is driven by a drive unit 68. The index pinch rollers apply a biasing force to hold the print media sheet 30 in contact with respective driven feed roller 66. Drive unit 68 includes a drive source, such as a stepper motor, and an associated drive mechanism, such as a gear train or belt/pulley arrangement. Feed roller unit 20 feeds the print media sheet 30 in a sheet feed direction 70, designated as an X in a circle to indicate that the sheet feed direction is out of the plane of FIG. 1 toward the reader. The sheet feed direction 70 is commonly referred to as the sub-scan direction, which is perpendicular to the horizontal bi-directional scanning path, and in turn, perpendicular to the horizontal carrier scan directions 62, 64. Thus, with respect to print media sheet 30, carrier reciprocation occurs in a horizontal direction and media advance occurs in a vertical direction, and the carrier reciprocation is generally perpendicular to the media advance.

Controller 24 includes a microprocessor having an associated random access memory (RAM) and read only memory (ROM). Controller 24 executes program instructions to effect the printing of an image on the print media sheet 30, such as for example, by selecting the index feed distance of print media sheet 30 along the print media path as conveyed by feed roller 66, controlling the reciprocation of printhead carrier 32, and controlling the operations of printheads 34, 36.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 68 via a communications link 76, such as for example an interface cable. Controller 24 is electrically connected and communicatively coupled to sheet picking unit 22 via a communications link 78, such as for example an interface cable.

Figure 2:
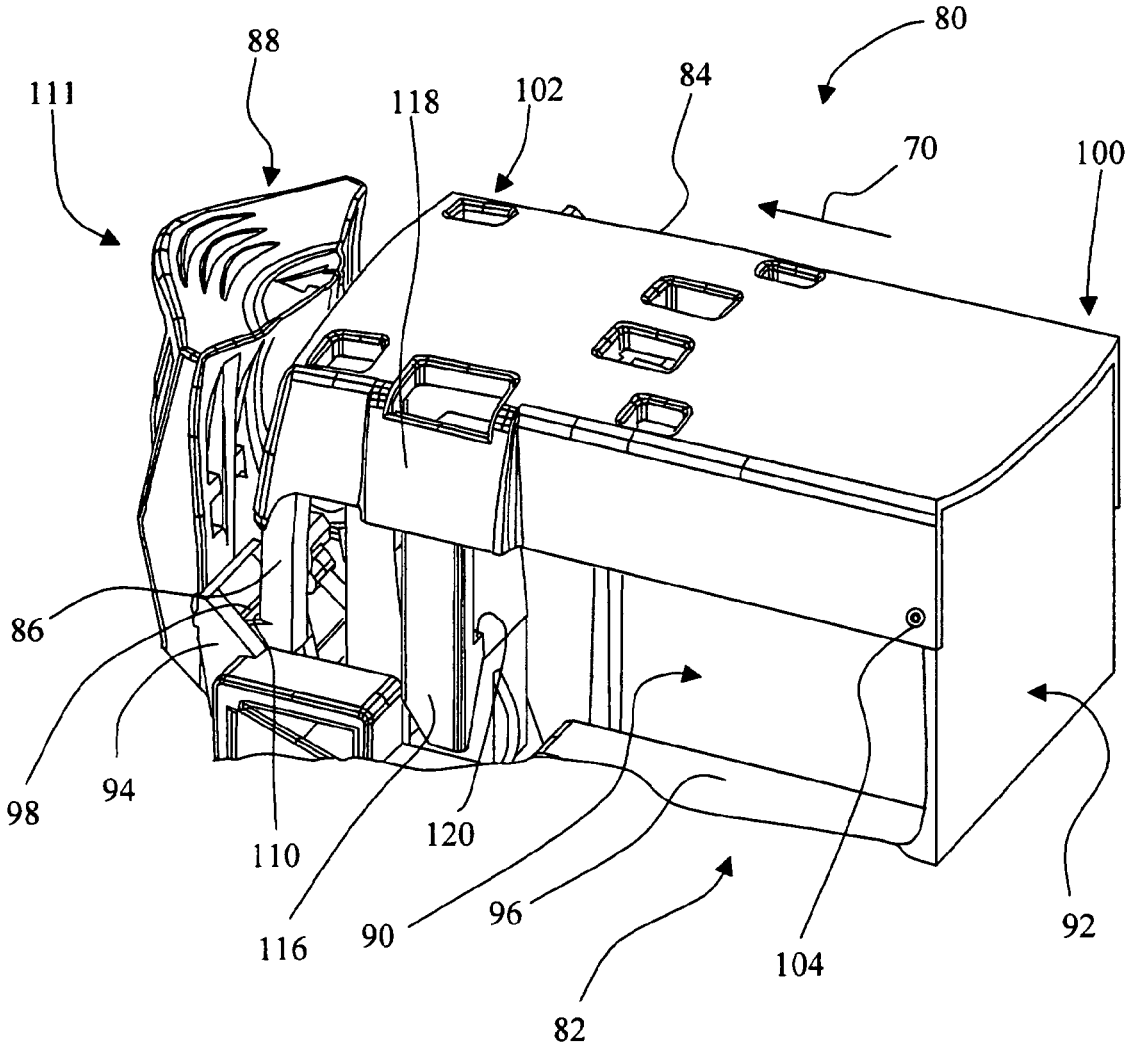
FIG. 2 is a perspective view of one embodiment of a portion of a printhead carrier in accordance with the present invention, with the cover in the closed position.
Figure 3:
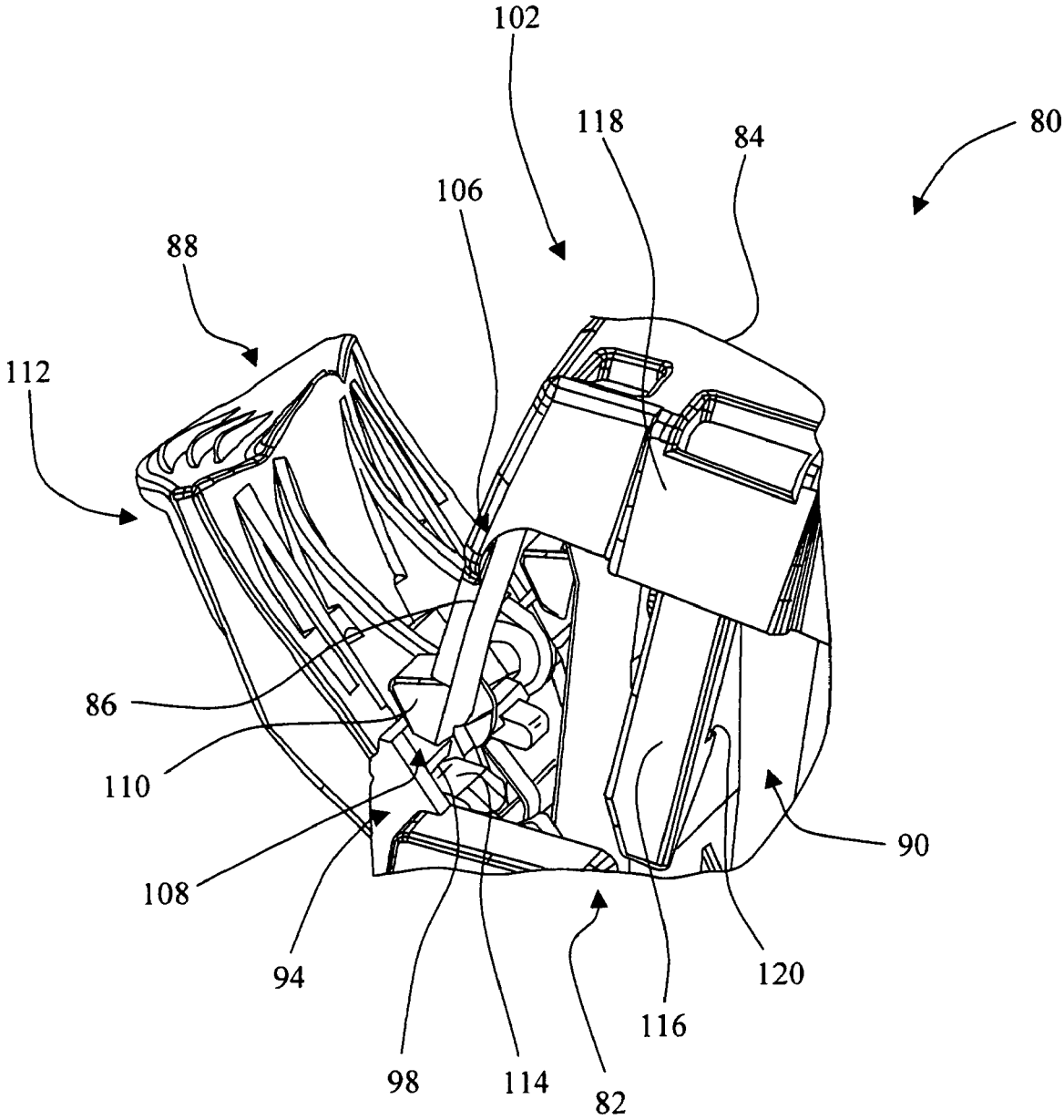
FIG. 3 is a perspective view of a portion of the printhead carrier FIG. 2, with the cover in the open position.

FIGS. 2 and 3 show an embodiment of a portion of a printhead carrier 80 in accordance with the present invention, which is suitable for use as printhead carrier 32 of FIG. 1.

Printhead carrier 80 includes a body 82, a cover 84, a latch arm 86 and a release mechanism 88. In FIG. 2, only one latch arm 86 is shown, but a second latch arm may be provided, for example, on the opposite side of cover 84.

Body 82 defines a receptacle 90 for receiving a supply cartridge, such as one of unitary printhead cartridges 41, 42. Body 82 includes, for example, a front portion 92, a rear portion 94, and a base 96. Rear portion 94 is spaced from front portion 92 in sheet feed direction 70. Rear portion 94 includes a latch opening 98.

Cover 84 has a first end 100 and a second end 102. First end 100 is configured for pivotal attachment to front portion 92 of body 82. Front portion 92 may include, for example, an end wall and/or side walls of receptacle 90. Such pivotal attachment may be accomplished via a pivot pin arrangement 104, as is well known in the art.

Latch arm 86 has a proximal end 106 and a distal end 108. Proximal end 106 is integrally attached to cover 84. Distal end 108 includes a latch lip 110. Latch lip 110 engages latch opening 98 in rear portion 94 of body 82 when cover 84 is in a closed position, as shown in FIG. 2.

Release mechanism 88, which may be in the form of a lever, as shown, is pivotally coupled to rear portion 94 of body 82. Rear portion 94 may include, for example, an end wall and or side walls of receptacle 90. Release mechanism 88 is pivotable between a latch (closed) position, 111, shown in FIG. 2, and a latch release (e.g., open) position 112, shown in FIG. 3. Release mechanism 88 includes a cam 114 for engaging latch lip 110 of latch arm 86 to force latch lip 110 out of latch opening 98 when release mechanism 88 is moved from latch position 111 to latch release position 112.

In addition, as cover 84 is moved from the open position shown in FIG. 3 to the closed position shown in FIG. 2, latch lip 110 of latch arm 86 engages cam 114 of release mechanism 88 to force release mechanism 88 into the latch position 111. Latch arm 86 may be designed to apply a constant force to release mechanism 88 at cam 114, in an attempt to eliminate possible noise associated with vibration of release mechanism 88 during use of ink jet printer 14.

Further shown in FIGS. 2 and 3 is an extraction device 116 to aid in extracting a supply cartridge, such as one of unitary printhead cartridges 41, 42, from receptacle 90. Extraction device 116 is attached to cover 84 along a lateral side 118 of cover 84, and may be formed integral therewith. Extraction device 116 includes a hook portion 120 for engaging the supply cartridge as cover 84 is moved toward its open position, as shown in FIG. 3.

Figure 4:
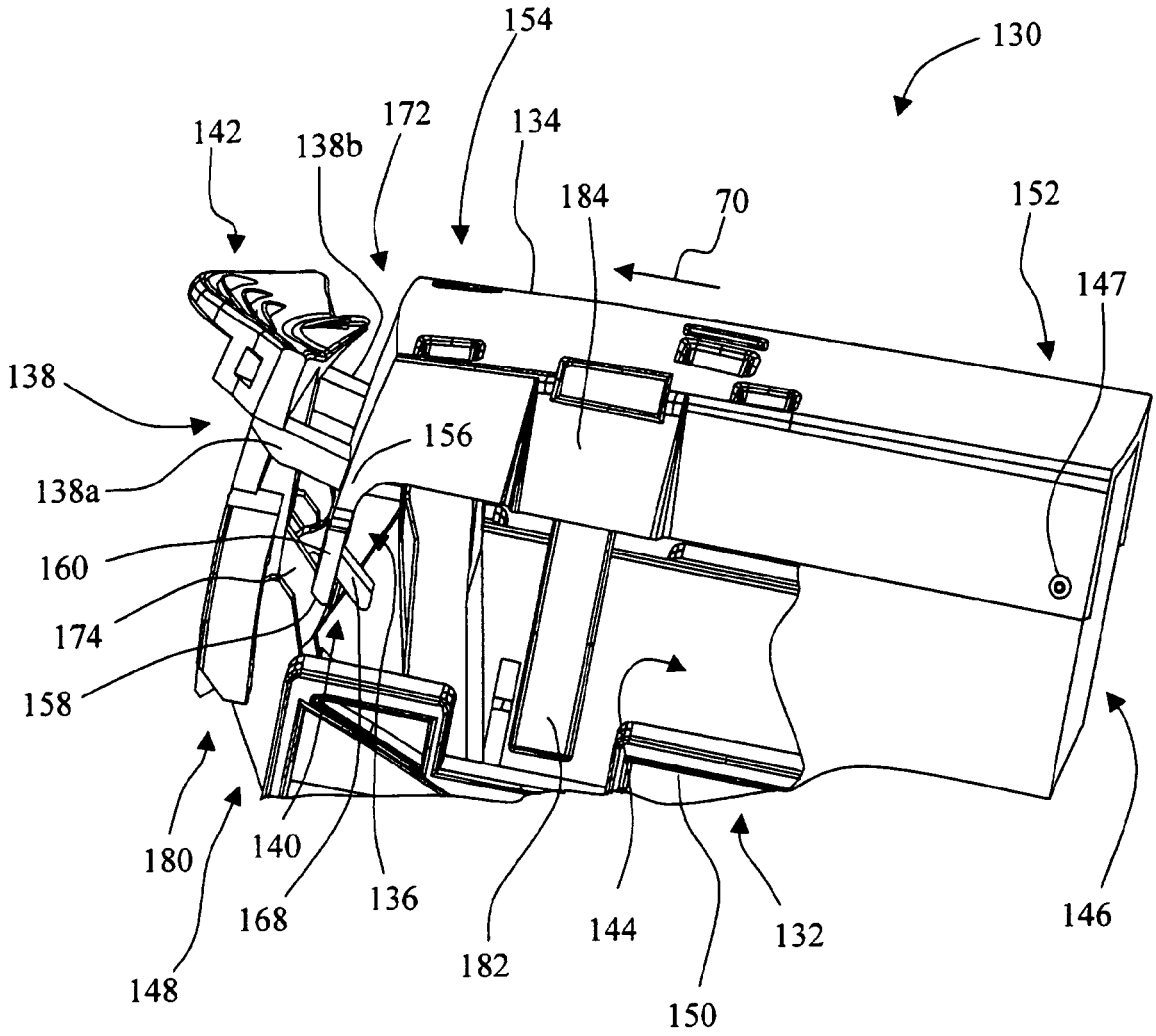
FIG. 4 is a perspective view of another embodiment of a portion of a printhead carrier in accordance with the present invention, with the cover in the closed position.
Figure 5:
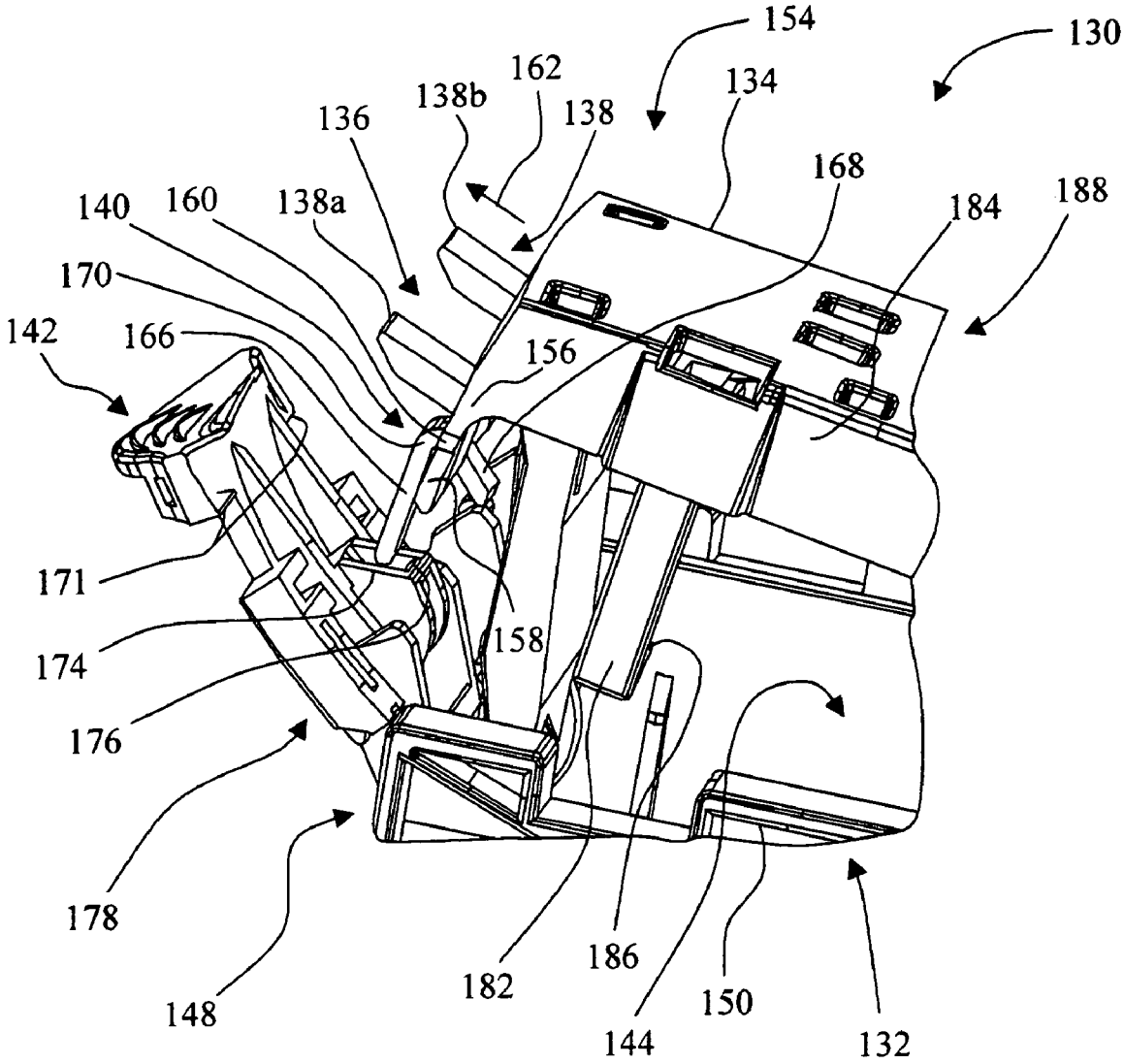
FIG. 5 is a perspective view of a portion of the printhead carrier of FIG. 4, with the cover in the open position.

FIGS. 4 and 5 show an embodiment of a portion of a printhead carrier 130 in accordance with the present invention, which is suitable for use as printhead carrier 32 of FIG. 1.

Printhead carrier 130 includes a body 132, a cover 134, a latch arm 136, a latch bar 138, a V-shaped member 140, and a latch lever 142.

Body 132 defines a receptacle 144 for receiving a supply cartridge, such as one of unitary printhead cartridges 41, 42. Body 132 includes a front portion 146, a rear portion 148, and a base 150. Rear portion 148 is spaced from front portion 146 in sheet feed direction 70.

Cover 134 has a first end 152 and a second end 154. First end 152 is configured for pivotal attachment to front portion 146 of body 132. Front portion 146 may include, for example, an end wall and/or side walls of receptacle 144. Such pivotal attachment may be accomplished via a pivot pin arrangement 147.

Latch arm 136 has a proximal end 156, a distal end 158 and an intermediate portion 160 between proximal end 156 and distal end 158. Proximal end 156 is integrally attached to cover 134.

Latch bar 138 is integrally attached to cover 134, and includes projections 138*a*, 138*b* that extend from cover 134 in a direction 162 substantially perpendicular to an extent of latch arm 136.

A V-shaped member 140 is integrally attached to latch arm 136, such as for example, to intermediate portion 160 of latch arm 136. V-shaped member 140 has a first leg 166, a second leg 168, and a divergence portion 170 defined where first leg 166 and second leg 168 separate.

Latch lever 142 is pivotally coupled to rear portion 148 of body 132. Rear portion 148 may include, for example, an end wall and/or side walls of receptacle 144. Latch lever 142 has a latch catch 171 for engaging latch bar 138 when cover 134 is moved toward, or is in, a closed position 172, as shown in FIG. 4. Latch lever 142 includes a guide channel 174 having an engagement ledge 176. Guide channel 174 is configured for receiving first leg 166 of V-shaped member 140 when cover 134 is pivoted toward closed position 172. Divergence portion 170 of V-shaped member 140 engages engagement ledge 176 of guide channel 174 of latch lever 142 to pivot latch lever 142 from a non-latched position 178, as shown in FIG. 5, to a latched position 180, as shown in FIG. 4 as cover 134 is pivoted from open position 188 toward closed position 172.

Further shown in FIGS. 4 and 5 is an extraction device 182 to aid in extracting a supply cartridge, such as one of unitary printhead cartridges 41, 42, from receptacle 144. Extraction device 182 is attached to cover 134 along a lateral side 184 of cover 134, and may be formed integral therewith. Extraction device 182 includes a hook portion 186 for engaging the supply cartridge as cover 134 is moved toward its open position 188, as shown in FIG. 5.

While this invention has been described with respect to embodiments of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus having a printhead carrier, said printhead carrier comprising:

a body defining a receptacle for receiving a supply cartridge, said body including a front portion, and a rear portion spaced from said front portion, said rear portion having a latch opening;

a cover having a first end and a second end, said first end being configured for pivotal attachment to said front portion of said body;

a latch arm having a proximal end and a distal end, said proximal end being attached to said cover, said distal end including a latch lip, said latch lip engaging said latch opening in said rear portion of said body when said cover is in a closed position; and a release mechanism coupled to said rear portion of said body, said release mechanism being pivotable between a latch position and a latch release position, said release mechanism including a cam for engaging said latch lip of said latch arm to force said latch lip out of said latch opening when said release mechanism is moved from said latch position to said latch release position.

2. The imaging apparatus of claim 1, wherein when said cover is moved from an open position to said closed position, said latch lip of said latch arm engages said cam of said release mechanism to force said release mechanism into said latch position.

3. A method for releasing a cover having a first end and a second end, said first end being configured for pivotal attachment to a front portion of a body defining a receptacle for receiving a supply cartridge, comprising: providing a latch arm having a proximal end and a distal end, said proximal end being attached to said cover, said distal end including a latch lip, said latch lip engaging a latch opening in a rear portion of said body when said cover is in a closed position; and pivoting a release mechanism between a latch position and a latch release position, said release mechanism forcing said latch lip out of said latch opening when said release mechanism is moved from said latch position to said latch release position, wherein said forcing said latch lip out of said latch opening is effected by a cam that engages said latch lip.

4. The method of claim 3, said release mechanism including a cam, wherein when said cover is moved from an open position to said closed position, said latch lip of said latch arm engages said cam of said release mechanism to force said release mechanism into said latch position.

5. An imaging apparatus having a printhead carrier, said printhead carrier comprising:

a body defining a receptacle for receiving a supply cartridge, said body including a front portion, and a rear portion spaced from said front portion;

a cover having a first end and a second end, said first end being configured for pivotal attachment to said front portion of said body;

a latch arm having a proximal end and a distal end, said proximal end being attached to said cover;

a latch bar extending from said cover in a direction substantially perpendicular to an extent of said latch arm;

a member attached to said latch arm, said member having a first leg and a second leg, and a divergence portion defined where said first leg and said second leg separate; and a latch lever pivotally coupled to said rear portion of said body, said latch lever having a latch catch for engaging said latch bar when said cover is in a closed position, said latch lever including a guide channel having an engagement ledge, said guide channel being configured for receiving said first leg of said member when said cover is pivoted toward said closed position, said divergence portion of said member engaging said engagement ledge of said guide channel of said latch lever to pivot said latch lever to a latched position as said cover is pivoted toward said closed position.

6. The imaging apparatus of claim 5, wherein said divergence portion, said first leg, and said second leg of said member together form a V-shape.

7. A method for releasing a cover having a first end and a second end, said first end being configured for pivotal attachment to a front portion of a body defining a receptacle for receiving a supply cartridge, comprising:

providing a latch arm having a proximal end, a distal end and an intermediate portion between said proximal end and said distal end, said proximal end being attached to said cover;

providing a latch bar attached to said cover and extending from said cover in a direction substantially perpendicular to an extent of said latch arm;

providing a member attached to said distal end of said latch arm, said member having a first leg and a second leg, and a divergence portion defined where said first leg and said second leg separate; and providing a latch lever pivotally coupled to a rear portion of said body, said latch lever having a latch catch for engaging said latch bar when said cover is in a closed position, said latch lever including a guide channel having an engagement ledge, said guide channel being configured for receiving said first leg of said member when said cover is pivoted toward said closed position, said divergence portion of said member engaging said engagement ledge of said guide channel of said latch lever to pivot said latch lever to a latched position as said cover is pivoted toward said closed position.

* * * * *